US012454760B2

(12) United States Patent
Maekawa et al.

(10) Patent No.: US 12,454,760 B2
(45) Date of Patent: Oct. 28, 2025

(54) ETCHANT AND METHOD OF SURFACE TREATMENT OF ALUMINUM OR ALUMINUM ALLOY

(71) Applicant: C.Uyemura & Co., Ltd., Osaka (JP)

(72) Inventors: Takuma Maekawa, Osaka (JP); Katsuhisa Tanabe, Osaka (JP); Sayuri Tanaka, Osaka (JP); Fuminori Shibayama, Osaka (JP)

(73) Assignee: C.Uyemura & Co., Ltd., Osaka (JP)

( * ) Notice: Subject to any disclaimer, the term of this patent is extended or adjusted under 35 U.S.C. 154(b) by 255 days.

(21) Appl. No.: 18/336,944

(22) Filed: Jun. 16, 2023

(65) Prior Publication Data

US 2023/0407487 A1 Dec. 21, 2023

(30) Foreign Application Priority Data

Jun. 16, 2022 (JP) ..... 2022-097315
Apr. 19, 2023 (JP) ..... 2023-068416

(51) Int. Cl.
*C23F 1/20* (2006.01)
*C23C 18/32* (2006.01)
*C23G 1/12* (2006.01)

(52) U.S. Cl.
CPC ..... *C23F 1/20* (2013.01); *C23C 18/32* (2013.01); *C23G 1/125* (2013.01)

(58) Field of Classification Search
None
See application file for complete search history.

(56) References Cited

U.S. PATENT DOCUMENTS 3,619,300 A * 11/1971 Heller ..... C23C 22/36 148/262
3,779,839 A * 12/1973 Kaihu ..... B23K 1/20 216/34
5,700,334 A * 12/1997 Ishii ..... C23C 22/44 148/273
5,895,563 A 4/1999 Muranushi
6,447,620 B1 * 9/2002 Komiyama ..... C09D 5/084 148/264
7,819,989 B2 * 10/2010 Ishikura ..... C23C 22/34 106/14.21

(Continued)

FOREIGN PATENT DOCUMENTS

CN 104250842 A 12/2014
EP 4177376 A1 5/2023

(Continued)

OTHER PUBLICATIONS

Tashiro, et al. "Relationship between Pretreatment and Initial Deposition in Electroless Nickel Plating on Aluminum Substrate." vol. 45, No. 7, 1994. pp. 54-59 (3 pages)

(Continued)

*Primary Examiner* — Allan W. Olsen
(74) *Attorney, Agent, or Firm* — Osha Bergman Watanabe & Burton LLP

(57) ABSTRACT

The present invention aims to provide an etchant that can provide good deposition of a metal plating such as a nickel plating, despite its acidity, and a method of surface treatment of aluminum or an aluminum alloy using the etchant. Included is an etchant containing a zinc compound and a fluorine compound and having a pH of 4.5 to 6.5.

7 Claims, 1 Drawing Sheet

(56) References Cited

U.S. PATENT DOCUMENTS

| | | | | |
|---|---|---|---|---|
| 2003/0171239 | A1* | 9/2003 | Patel | C11D 3/28 510/412 |
| 2004/0244874 | A1* | 12/2004 | Nakayama | C23C 22/34 148/247 |
| 2005/0008788 | A1* | 1/2005 | Joshi | C23C 18/1651 427/430.1 |
| 2006/0040212 | A1* | 2/2006 | Matsuura | C25F 3/04 430/300 |
| 2009/0004491 | A1* | 1/2009 | Sato | C23G 1/086 428/472 |
| 2010/0044341 | A1 | 2/2010 | Uchida et al. | |
| 2017/0204523 | A1* | 7/2017 | Prokopiak | C23F 1/02 |
| 2019/0177670 | A1* | 6/2019 | Kamimura | C11D 1/345 |
| 2023/0151493 | A1* | 5/2023 | Maekawa | C23C 18/32 427/328 |

FOREIGN PATENT DOCUMENTS

| | | | |
|---|---|---|---|
| JP | 2000-256864 | A | 9/2000 |
| JP | 2010-47802 | A | 3/2010 |
| JP | 2011-105977 | A | 6/2011 |
| JP | 2012-062528 | A | 3/2012 |
| JP | 2014-136806 | A | 7/2014 |
| JP | 2020-196914 | A | 12/2020 |
| JP | 2021-143422 | A | 9/2021 |

OTHER PUBLICATIONS

Hara, Kenji. "Pre-Treatment in the Surface Treatment of Aluminum." vol. 69, No. 9, 2018. pp. 16-19 (3 pages).

* cited by examiner

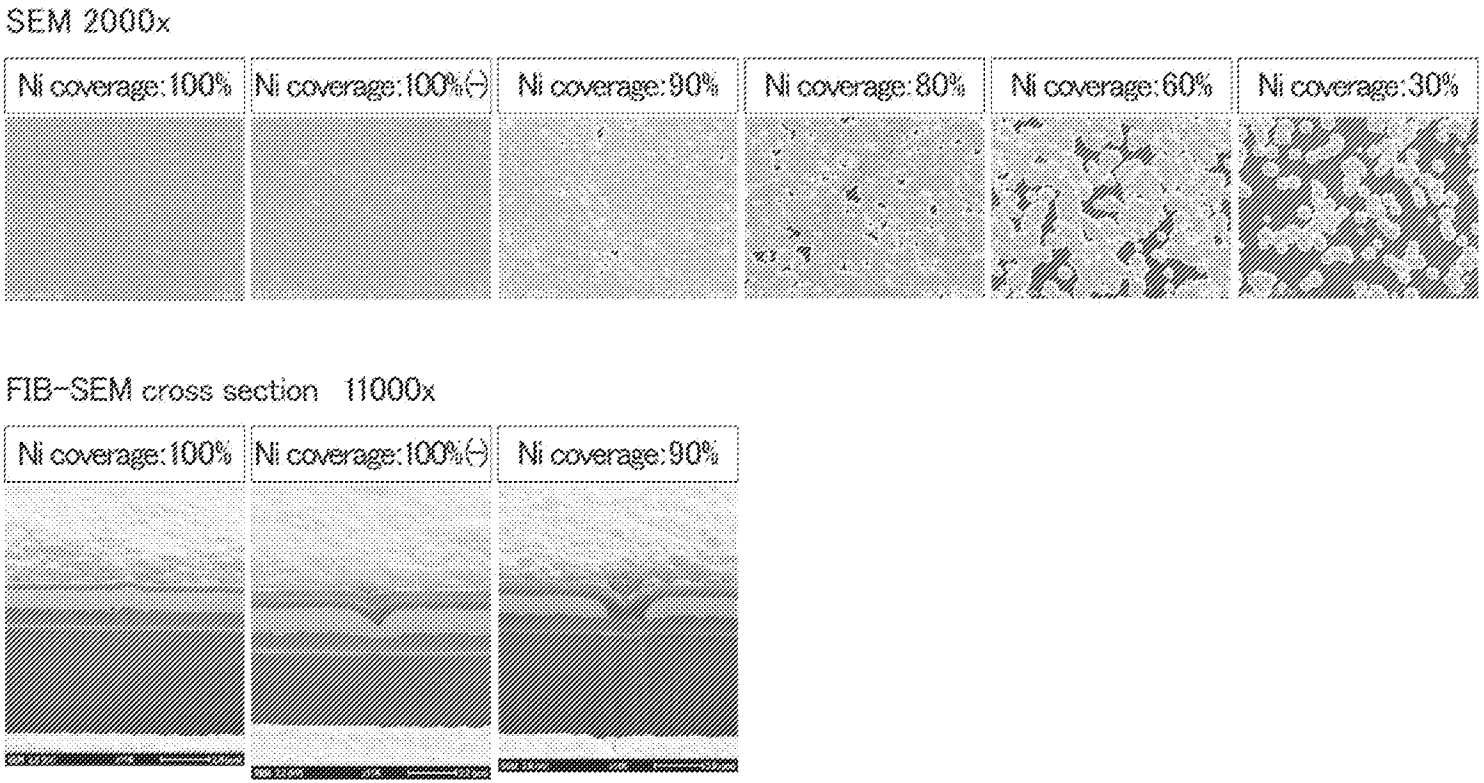
SEM 2000x
Ni coverage:100%
Ni coverage:100%(-)
Ni coverage:90%
Ni coverage:80%
Ni coverage:60%
Ni coverage:30%
FIB-SEM cross section 11000x
Ni coverage:100%
Ni coverage:100%(-)
Ni coverage:90%

ETCHANT AND METHOD OF SURFACE TREATMENT OF ALUMINUM OR ALUMINUM ALLOY

TECHNICAL FIELD

The present invention relates to an etchant and a method of surface treatment of aluminum or an aluminum alloy.

BACKGROUND ART

Aluminum readily forms an oxide film in the air or water. It is known that when aluminum or an aluminum alloy is subjected to plating, the plating film has low adhesion due to such an oxide film. Thus, in the process for plating on aluminum or an aluminum alloy, an etching step is performed to remove the natural oxide film formed on the aluminum or aluminum alloy surface in order to condition the aluminum or aluminum alloy surface prior to a zinc displacement (zincate treatment) step (for example, Patent Literatures 1 and 2 and Non-Patent Literatures 1 and 2).

CITATION LIST

Patent Literature

Patent Literature 1: JP 2021-143422 A
Patent Literature 2: JP 2012-62528 A

Non-Patent Literature

Non-Patent Literature 1: Journal of The Surface Finishing Society of Japan, Vol. 69 (2018), No. 9, pp. 380-383
Non-Patent Literature 2: Journal of The Surface Finishing Society of Japan, Vol. 45 (1994), No. 7, pp. 720-725

SUMMARY OF INVENTION

Technical Problem

Extensive studies by the present inventors have revealed the following.

Etchants are roughly classified into two types: alkaline etchants and acidic etchants. Alkaline etchants have higher etching ability due to the presence of alkaline components, but can attack materials vulnerable to alkaline components, such as solder resists. On the other hand, acidic etchants have a lower etching effect than alkaline etchants and may fail to sufficiently remove the oxide film, resulting in poor deposition in the subsequent electroless nickel plating step as compared to when using alkaline etchants.

As described above, it has been found that conventional techniques with acidic etchants have room for improvement in terms of deposition of a metal plating such as a nickel plating.

The present invention aims to solve the problem newly found by the present inventors and provide an etchant that can provide good deposition of a metal plating such as a nickel plating, despite its acidity, and a method of surface treatment of aluminum or an aluminum alloy using the etchant.

Solution to Problem

As a result of extensive studies, the present inventors have found that the use of an etchant having a specific composition can provide good deposition of a metal plating such as a nickel plating, despite its acidity. This finding has led to the completion of the present invention.

Specifically, exemplary embodiments of the present invention include:

Embodiment 1. An etchant, containing at least one zinc compound and at least one fluorine compound, the etchant having a pH of 4.5 to 6.5.

Embodiment 2. The etchant according to Embodiment 1, wherein the etchant contains the zinc compound in an amount corresponding to a zinc concentration of 1.0 to 10 g/L.

Embodiment 3. The etchant according to Embodiment 1 or 2, wherein the etchant contains the fluorine compound in an amount corresponding to a fluorine concentration of 1.0 to 20.5 g/L.

Embodiment 4. The etchant according to any one of Embodiments 1 to 3, wherein the etchant is for treating aluminum or an aluminum alloy.

Embodiment 5. A method of surface treatment of aluminum or an aluminum alloy, the method including a treatment including: bringing a workpiece having aluminum or an aluminum alloy on its surface into contact with the etchant according to any one of Embodiments 1 to 4 for etching; and pickling the etched workpiece.

Embodiment 6. The method of surface treatment of aluminum or an aluminum alloy according to Embodiment 5, wherein the treatment is repeated at least twice.

Embodiment 7. The method of surface treatment of aluminum or an aluminum alloy according to Embodiment 6, wherein the etchant used in each repetition of the treatment has the same composition.

Embodiment 8. The method of surface treatment of aluminum or an aluminum alloy according to any one of Embodiments 5 to 7, wherein the method includes zinc displacement after the treatment.

Embodiment 9. The method of surface treatment of aluminum or an aluminum alloy according to Embodiment 8, wherein the method includes forming a metal plating film after the zinc displacement.

Advantageous Effects of Invention

The etchant according to the present invention contains a zinc compound and a fluorine compound and has a pH of 4.5 to 6.5 and thus can provide good deposition of a metal plating such as a nickel plating, despite its acidity.

BRIEF DESCRIPTION OF DRAWINGS

The FIGURE shows typical examples of plating films.

DESCRIPTION OF EMBODIMENTS

The etchant of the present invention contains a zinc compound and a fluorine compound and has a pH of 4.5 to 6.5. When the etchant of the present invention is used for etching, good deposition of a metal plating such as a nickel plating can be provided in a subsequent step of forming a metal plating film such as a nickel plating. Thus, the present invention can provide good deposition of a metal plating such as a nickel plating, despite the acidity of the etchant. Further, due to the acidity of the etchant of the present invention, it is possible to reduce the corrosion of materials caused by alkaline components.

The reason why the etchant provides the above-mentioned advantageous effect is believed to be as follows.

When a workpiece having aluminum or an aluminum alloy on its surface is brought into contact with the etchant to remove the oxide film on the aluminum or aluminum alloy and replace a part of the aluminum with the zinc in the etchant, the aluminum surface can be conditioned to suit zinc displacement prior to the zinc displacement.

Moreover, the etchant of the present invention containing a zinc compound as well as a fluorine compound can dissolve aluminum despite its acidity. Thus, the etchant can dissolve the aluminum in the oxide film on the aluminum or aluminum alloy surface to allow it to be smoothly replaced with zinc, so that the aluminum surface can be more suitably conditioned to suit zinc displacement.

As described above, the etchant of the present invention can condition the aluminum surface to suit zinc displacement due to the synergy between the zinc compound and the fluorine compound.

Moreover, when the aluminum or aluminum alloy with such a conditioned surface is subjected to zinc displacement and then plating to form a plating film (a metal plating film, e.g., a nickel plating film), good deposition of the metal plating such as nickel plating is provided.

<Etchant>

The etchant of the present invention contains a zinc compound and a fluorine compound and has a pH of 4.5 to 6.5.

<<Zinc Compound>>

The zinc compound can immediately deposit Zn on the aluminum surface where the oxide film has been removed, thereby conditioning the aluminum surface to suit zinc displacement.

The zinc compound may be any water-soluble zinc compound. Specific examples include zinc sulfate, zinc nitrate, zinc chloride, zinc acetate, zinc oxide, and zinc gluconate. These may be used alone or in combinations of two or more. Zinc sulfate is preferred among these.

The etchant preferably contains at least one zinc compound in an amount corresponding to a zinc (metallic zinc (Zn)) concentration of 1.0 to 20 g/L, more preferably 1.0 to 10 g/L, still more preferably 2.0 to 10 g/L, particularly preferably 3.0 to 8.0 g/L. When the concentration is within the range indicated above, the etchant tends to provide a moderate amount of Zn deposition, so that the aluminum surface can be conditioned to suit zinc displacement.

<<Fluorine Compound>>

The fluorine compound can dissolve aluminum even when it is under acidic conditions. Thus, the fluorine compound can dissolve the aluminum in the oxide film on the aluminum or aluminum alloy surface to allow it to be smoothly replaced with a metal such as zinc.

Specific examples of the fluorine compound include hydrofluoboric acid, sodium fluoride, potassium fluoride, ammonium hydrogen fluoride, ammonium fluoride, hydrogen fluoride, and lithium fluoride. These may be used alone or in combinations of two or more. Preferred among these are hydrofluoboric acid, sodium fluoride, potassium fluoride, ammonium hydrogen fluoride, ammonium fluoride, and hydrogen fluoride, with sodium fluoride, potassium fluoride, ammonium hydrogen fluoride, ammonium fluoride, and hydrogen fluoride being more preferred, with sodium fluoride, potassium fluoride, ammonium hydrogen fluoride, and ammonium fluoride being still more preferred.

The etchant preferably contains at least one fluorine compound in an amount corresponding to a fluorine (F) concentration of 0.5 to 40 g/L, more preferably 1.0 to 20.5 g/L, still more preferably 2.0 to 15 g/L, particularly preferably 3.0 to 10 g/L, most preferably 4.0 to 8.0 g/L. When the concentration is within the range indicated above, the etchant tends to have a moderate ability to dissolve aluminum oxide, so that the aluminum surface can be conditioned to suit zinc displacement.

<<Nickel Compound>>

Any nickel compound that is water-soluble may be used. Specific examples include nickel sulfate, nickel nitrate, nickel chloride, nickel acetate, and nickel gluconate. These may be used alone or in combinations of two or more.

The amount of nickel compounds, calculated as nickel (metallic nickel (Ni)) concentration, in the etchant is preferably less than 0.1 g/L, more preferably not more than 0.05 g/L, still more preferably not more than 0.01 g/L. In this case, the advantageous effect of the present invention tends to be better achieved.

<<Germanium Compound>>

Any germanium compound that is water-soluble may be used. Specific examples include germanium dioxide, germanium sulfate, germanium sulfide, germanium fluoride, germanium chloride, and germanium iodide. These may be used alone or in combinations of two or more.

The amount of germanium compounds, calculated as germanium (metallic germanium (Ge)) concentration, in the etchant is preferably less than 0.1 g/L, more preferably not more than 0.05 g/L, still more preferably not more than 0.01 g/L. In this case, the advantageous effect of the present invention tends to be better achieved.

<<Iron Compound>>

Any iron compound that is water-soluble may be used. Specific examples include iron sulfate, iron nitrate, iron chloride, iron acetate, and iron gluconate. These may be used alone or in combinations of two or more.

The amount of iron compounds, calculated as iron (metallic iron (Fe)) concentration, in the etchant is preferably less than 0.1 g/L, more preferably not more than 0.05 g/L, still more preferably not more than 0.01 g/L. In this case, the advantageous effect of the present invention tends to be better achieved.

The amount of metal compounds other than zinc compounds, calculated as metal concentration, in the etchant is preferably less than 0.1 g/L, more preferably not more than 0.05 g/L, still more preferably not more than 0.01 g/L. In this case, the advantageous effect of the present invention tends to be better achieved.

Here, when the etchant contains a plurality of metals other than zinc, the metal concentration refers to the total concentration. The same applies to the concentrations of other components.

Herein, the metal concentrations in the etchant, such as the zinc (metallic zinc (Zn)) concentration, the nickel (metallic nickel (Ni)) concentration, the germanium (metallic germanium (Ge)) concentration, and the iron (metallic iron (Fe)) concentration, can be measured with CIP (HORIBA, Ltd.).

Also, herein, the fluorine (F) concentration in the etchant can be measured using a fluoride ion electrode.

Herein, a compound which falls into both a germanium compound and a fluorine compound, such as germanium fluoride, is regarded as a germanium compound. Corresponding zinc, nickel, and iron compounds are also regarded as zinc, nickel, and iron compounds, respectively.

<<pH>>

The pH of the etchant is preferably 4.5 to 6.5, more preferably 5.0 to 6.5, still more preferably 5.5 to 6.5, particularly preferably 6.0 to 6.5. At a pH of 4.5 or more, excessive dissolution of aluminum tends to be reduced, so that the aluminum surface can be conditioned to suit zinc displacement. At a pH of 6.5 or less, insolubilization of zinc tends to be reduced, so that the aluminum surface can be conditioned to suit zinc displacement.

Herein, the pH of the etchant is measured at 25° C.

The pH of the etchant may be adjusted by selecting the type of the zinc compound or fluorine compound. An alkaline component or an acid component may also be added, as necessary.

Non-limiting examples of the alkaline component include sodium hydroxide and ammonium. Non-limiting examples of the acid component include sulfuric acid and phosphoric acid. These alkaline or acid components may be used alone or in combinations of two or more.

The etchant may contain a buffer to enhance the pH buffering capacity.

The buffer may be any compound having a buffering capacity. Examples of compounds having a buffering capacity around a pH of 4.5 to 6.5 include acetic acid, malic acid, succinic acid, citric acid, malonic acid, lactic acid, oxalic acid, glutaric acid, adipic acid, and formic acid. These may be used alone or in combinations of two or more.

The buffer concentration in the etchant is preferably 1.0 to 50 g/L, more preferably 5.0 to 30 g/L.

<<Other Components>>

The etchant may contain, in addition to the above-described components, components that are generally used in etchants, such as surfactants and brightening agents. The etchant may also contain water-soluble salts of metals other than the above-described metals, such as copper, silver, palladium, lead, bismuth, and thallium. These may be used alone or in combinations of two or more.

The etchant can be prepared by appropriately mixing the components using a solvent, preferably water. Although the etchant is preferably prepared as an aqueous solution for operational safety, other solvents such as methanol, ethanol, ethylene glycol, diethylene glycol, triethylene glycol, glycerol, and IPA may be used, or they may be used as a solvent mixture with water. Here, these solvents may be used alone or in combinations of two or more.

The etchant can be suitably used as an etchant for treating aluminum or an aluminum alloy.

<Method of Surface Treatment of Aluminum or Aluminum Alloy>

The following describes a method of surface treatment of aluminum or an aluminum alloy of the present invention using the etchant of the present invention.

The method of surface treatment of aluminum or an aluminum alloy of the present invention is not limited as long as it includes bringing a workpiece having aluminum or an aluminum alloy on its surface into contact with the etchant of the present invention for etching. Preferably, the method includes a treatment process including bringing a workpiece having aluminum or an aluminum alloy on its surface into contact with the etchant of the present invention for etching, and pickling the etched workpiece.

A workpiece having aluminum or an aluminum alloy on its surface may be brought into contact with the etchant of the present invention for etching to remove the oxide film on the aluminum or aluminum alloy. In this process, a part of the aluminum may be replaced with the zinc in the etchant to form a replacement zinc film containing zinc on the surface of the workpiece. The surface of the workpiece provided with the replacement zinc film may be subjected to pickling to remove etching residues (smuts), so that the aluminum surface can be conditioned to better suit zinc displacement, and therefore good deposition of a metal plating such as a nickel plating can be provided on the aluminum. With such a pickling, the advantageous effect of the present invention tends to be more suitably achieved.

<<Treatment Process>>

The treatment process includes bringing a workpiece having aluminum or an aluminum alloy on its surface (hereinafter, also referred to as aluminum substrate) into contact with the etchant of the present invention for etching, and pickling the etched workpiece.

The aluminum substrate, which is an object to be plated, may be any substrate that has aluminum or an aluminum alloy at least on its surface. Examples of the aluminum substrate include various articles made of aluminum or aluminum alloys, articles in which an aluminum or aluminum alloy film is formed on a non-aluminum material (e.g., any of various substrates such as ceramic substrates and wafers), hot-dip aluminized articles, castings, and die castings. The aluminum substrate may also have any shape and may be in the form of a typical plate (including a film, a sheet, or other thin films) or in the form of any formed article of any of various shapes. Moreover, the plate is not limited to a plate made of aluminum or an aluminum alloy alone, and may include, for example, an aluminum film that is formed on (integrated with) a substrate such as a ceramic substrate or a wafer by sputtering, vacuum deposition, ion plating, or other conventional techniques.

The aluminum alloy may be, but is not limited to, for example, any of various alloys containing aluminum as a main metal component. Examples of applicable alloys include A1000 series quasi-aluminum, A2000 series aluminum alloys containing copper and manganese, A3000 series aluminum-manganese alloys, A4000 series aluminum-silicon alloys, A5000 series aluminum-magnesium alloys, A6000 series aluminum-magnesium-silicon alloys, A7000 series aluminum-zinc-magnesium alloys, and A8000 series aluminum-lithium alloys.

The aluminum purity of the aluminum or aluminum alloy is preferably 98% or higher, more preferably 98.5% or higher, still more preferably 99% or higher, from the standpoint of plating smoothness.

The aluminum substrate, which is an object to be plated, can be prepared by coating a non-aluminum material such as a silicon plate with an aluminum layer using well-known techniques such as sputtering. The non-aluminum material may be fully or partially coated with the aluminum layer which usually has a thickness of 0.5 μm or more, preferably 1 μm or more. Moreover, the method for preparing the aluminum substrate is not limited to sputtering and may include vacuum deposition, ion plating, or other techniques.

First, the thus-prepared aluminum substrate may be subjected to a cleaner treatment such as degreasing by a well-known method and then rinsing with water as appropriate. Specifically, the degreasing may be carried out by immersion in a degreasing solution for aluminum or by electrolytic degreasing, as appropriate.

The etching is not limited as long as the workpiece having aluminum or an aluminum alloy on its surface is brought into contact with the etchant of the present invention. It may be carried out as in the prior art, except that the etchant of the present invention is used.

Specifically, the workpiece having aluminum or an aluminum alloy on its surface may be immersed in the etchant of the present invention for etching. More specifically, for example, the aluminum substrate may be immersed in the etchant of the present invention at a liquid temperature of preferably 25 to 60° C., more preferably 30 to 55° C., still more preferably 35 to 50° C. When the temperature of the etchant of the present invention is within the range indicated above, the aluminum surface can be more suitably conditioned to suit zinc displacement. Moreover, too high a treatment temperature may increase corrosion of materials such as glass components.

The conditions of the immersion period are not limited either, and may be selected appropriately in consideration of, for example, the thickness of the aluminum oxide film to be removed. For example, the immersion period is usually about five seconds or longer, preferably 10 seconds or longer, more preferably 20 seconds or longer. The upper limit is usually five minutes or shorter, preferably two minutes or shorter, more preferably one minute or shorter.

Such immersion of the aluminum substrate in the etchant of the present invention can remove the oxide film adhered to the substrate surface and can further coat the surface with a Zn-containing replacement metal film to activate the aluminum surface, so that the aluminum surface can be more suitably conditioned to suit zinc displacement.

The etching is not limited as long as it is an embodiment in which the etchant of the present invention can be brought into contact with the surface of the aluminum substrate. Examples of such contact methods include, in addition to immersion, application and spraying.

Next, for example, the etched aluminum substrate may be immersed in an acidic solution for a predetermined time for pickling in order to remove etching residues (smuts). The pickling may be carried out as in the prior art. Specifically, for example, the etched aluminum substrate may be immersed in an aqueous acid solution at an acid concentration within the range of 10 to 80% by mass, preferably 20 to 50% by mass, and a solution temperature of 15 to 35° C. for 20 seconds to two minutes to remove the smuts.

Examples of the acid used in the pickling include nitric acid, hydrochloric acid, sulfuric acid, and phosphoric acid. These may be used alone or in combinations of two or more. Nitric acid is preferred among these.

Although an example of pickling in which the aluminum substrate is immersed in an acidic solution is described above, methods other than immersion may be employed, such as continuous passage of an acidic solution onto the aluminum substrate, application, and spraying.

In the treatment process in which a workpiece having aluminum or an aluminum alloy on its surface is brought into contact with the etchant of the present invention for etching, and then the etched workpiece is pickled, the aluminum surface can be more suitably conditioned to suit zinc displacement.

The treatment process is preferably repeated at least twice, more preferably twice. In this case, the advantageous effect of the present invention tends to be better achieved with high productivity.

Moreover, the etchant used in each repetition of the treatment process preferably has the same composition. In this case, the advantageous effect of the present invention tends to be better achieved with high productivity.

Here, the expression "the treatment process is repeated" means that a series of "etching and pickling" steps are performed multiple times. When it is said that the treatment process is repeated twice, it is meant that "etching and pickling" are performed and then "etching and pickling" are performed. Moreover, another step (such as rinsing with water) may be performed between the repeated "etching and pickling" steps. Moreover, another step (such as rinsing with water) may be performed between "etching" and "pickling".

The method of surface treatment of aluminum or an aluminum alloy of the present invention preferably includes zinc displacement after the treatment process.

The zinc displacement is a pretreatment prior to the application of a metal plating film, such as a nickel plating film or a palladium plating film, to a workpiece, in which a workpiece having aluminum or an aluminum alloy at least on its surface may be brought into contact with a zincate treatment solution to form a zinc film, thereby further increasing the adhesion of a metal plating film such as a nickel plating or other film to be formed in a subsequent treatment.

In general, in a pre-plating treatment of an aluminum substrate with a zincate treatment solution, a double zincate process is used in which zinc displacement is performed twice. Specifically, the process includes: (1) a first zinc displacement of an aluminum substrate, (2) pickling, and then (3) a second zinc displacement. The double zincate process is followed by (4) metal plating such as electroless nickel plating.

In contrast, as the method of surface treatment of aluminum or an aluminum alloy of the present invention using the etchant of the present invention can more suitably condition the aluminum surface to suit zinc displacement, the method can eliminate the need for a double zincate process and allow a single zincate process to provide good adhesion of a metal plating film such as a nickel plating to be formed in a subsequent treatment. Thus, in the method of surface treatment of aluminum or an aluminum alloy of the present invention, preferably, (1) metal displacement of an aluminum substrate is performed, and this single zincate process is followed by (4) metal plating such as electroless nickel plating. In other words, preferably, (2) pickling and (3) a subsequent second metal displacement are not performed between the metal displacement and the metal plating.

<<(1) Metal Displacement>>

The aluminum substrate treated in the above-described treatment process may be immersed in a zincate treatment solution for metal displacement. The metal displacement using a zincate treatment solution may be carried out as in the prior art. For example, the aluminum substrate may be immersed in a zincate treatment solution at a solution temperature of 10 to 50° C., preferably 15 to 30° C. The temperature of the zincate treatment solution as indicated above is preferred because, when it is 10° C. or higher, the displacement reaction will not become too slow and a metal film without irregularities can be formed, while when it is 50° C. or lower, the displacement reaction will not be excessively increased and the surface of the displacement metal film can be prevented from becoming rough.

The conditions of the immersion period are not limited either. For example, the immersion period is usually about five seconds or longer, preferably 10 seconds or longer, and the upper limit thereof is five minutes or shorter.

Such immersion of the aluminum substrate in the zincate treatment solution can coat the aluminum substrate with a Zn-containing displacement metal film to activate the aluminum surface, thereby enabling the formation of a plating film having good adhesion onto the workpiece.

The metal displacement is not limited as long as it is an embodiment in which the zincate treatment solution can be brought into contact with the surface of the aluminum substrate. Examples of such contact methods include, in addition to immersion, application and spraying.

The zincate treatment solution used in the metal displacement may be either acidic or alkaline. The acidic zincate treatment solution preferably contains a fluorine compound. The acidic zincate treatment solution may contain various metals such as nickel and germanium in addition to zinc. The alkaline zincate treatment solution may contain various metals such as iron and cobalt in addition to zinc. The acidic zincate treatment solution is preferred because it has less influence on materials.

<<(4) Plating>>

In the plating (metal plating), a metal plating film may be formed on the zincated aluminum substrate by electroless plating or electrolytic plating. For example, plating may be performed using an appropriate metal plating bath (metal plating solution) such as an electroless nickel, electroless palladium, or copper plating bath to a desired final film thickness, thereby forming a metal plating film. The metal plating film formed by plating is preferably an electroless metal plating film, more preferably an electroless nickel plating film, because the advantageous effect of the present invention tends to be better achieved.

The following specifically describes an example of electroless nickel plating. For example, an electroless nickel plating bath contains a water-soluble nickel salt such as nickel sulfate, nickel chloride, or nickel acetate, which provides nickel ions at a concentration of, for example, about 1 to 10 g/L. The electroless nickel plating bath may also contain, for example: a nickel complexing agent such as an organic acid salt (e.g., acetate, succinate, or citrate), an ammonium salt, or an amine salt at a concentration within the range of about 20 to 80 g/L; and hypophosphorous acid or a hypophosphite such as sodium hypophosphite as a reducing agent at a concentration within the range of about 10 to 40 g/L. The presence of a hypophosphite or the like as a reducing agent can increase the stability of the plating bath and enable the formation of a low-cost nickel-phosphorus alloy film. Then, the pH of the plating bath containing these compounds may be adjusted to about 4 to 7 before use. Further, the solution temperature of the plating bath may be adjusted to 60 to 95° C., and the aluminum substrate may be immersed in the plating solution for about 15 seconds to 120 minutes to perform plating. Moreover, the thickness of the plating film may be varied by changing the plating period as appropriate.

Here, the plating is not limited to electroless plating and may be carried out by electrolytic plating, as described above. Besides the above-mentioned types of plating metals, other plating metals such as Cu and Au may also be used. Moreover, the plating may be carried out by displacement plating or other techniques to form two or more layers.

The conditions and concentration settings of the treatments described above are not limited to those described above. Obviously, they can be appropriately changed depending on the thickness of the film to be formed, etc.

The aluminum or aluminum alloy provided with a plating film (metal film) according to the present invention can be used in various electronic components. Examples of the electronic components include electronic components used in home appliances, in-vehicle equipment, power transmission systems, transportation equipment, and communication equipment. Specific examples include power modules such as power control units for air conditioners, elevators, electric vehicles, hybrid vehicles, trains, and power generation equipment, general home appliances, and personal computers.

EXAMPLES

The present invention will be specifically described with reference to examples, but the invention is not limited to these examples.

An aluminum substrate was subjected to various treatments according to the conditions shown in Tables 1 and 2 to form a plating film. The aluminum substrate used here was a 1 cm×2 cm Al—Si TEG wafer. The plating film was evaluated as described below. Tables 1 and 2 show the evaluation results.

It should be noted that, in Tables 1 and 2, the numerical values (concentrations) were calculated as the concentration (g/L) of fluorine (F) or each metal element, except for succinic acid, activator, and pH adjuster.

Moreover, the treatment steps in Table 1 were performed in order from top to bottom. In the table, the liquid chemicals listed as "EPITHAS" are all available from C. Uyemura & Co., Ltd.

<Deposition of Nickel Plating>

Measurement substrate: 1 cm×2 cm Al—Si TEG wafer

Surface SEM: SU3500, Hitachi High-Technologies Corporation, 2000×

Cross-sectional SEM: XVision 210DB, Hitachi High-Technologies Corporation, 11000×

Evaluation method: The Ni-plated surface was observed by SEM to estimate the ratio of the area covered with Ni. When the ratio was 100%, a cross-section was observed to confirm the full coverage with a Ni film, and then 100% was given if the film was flat, while 100%(–) was given if the film was dented.

The FIGURE shows typical examples of the evaluation results.

TABLE 1

| Treatment process | | | | | | | | | | | | | | | |
|---|---|---|---|---|---|---|---|---|---|---|---|---|---|---|---|
| Liquid chemical | | Comp. Ex. 1 | Comp. Ex. 2 | Ex. 1 | Ex. 2 | Comp. Ex. 3 | Comp. Ex. 4 | Comp. Ex. 5 | Comp. Ex. 6 | Ex. 3 | Ex. 4 | Ex. 5 | Ex. 6 | Ex. 7 | Ex. 8 |
| Cleaner | EPITHAS MCL-16 | 300 s | 300 s | 300 s | 300 s | | | | | 300 s | 300 s | 300 s | | | |
| Etching | EPITHAS LEC-40 (Zn-containing alkaline etching) | 120 s | 120 s | | | | | | | | | | | | |
| | Composition Example 1-3 | | | 60 s | 60 s | | | | | 30 s | 30 s | 30 s | 30 s | 60 s | 30 s |
| | Composition Comparative Example 1-3 (Zn not added) | | | | | 30 s | 60 s | 120 s | 30 s | | | | | | |

TABLE 1-continued

| Treatment process | | | | | | | | | | | | | | | |
|---|---|---|---|---|---|---|---|---|---|---|---|---|---|---|---|
| Liquid chemical | | Comp. Ex. 1 | Comp. Ex. 2 | Ex. 1 | Ex. 2 | Comp. Ex. 3 | Comp. Ex. 4 | Comp. Ex. 5 | Comp. Ex. 6 | Ex. 3 | Ex. 4 | Ex. 5 | Ex. 6 | Ex. 7 | Ex. 8 |
| Nitric acid pickling | 30 wt. % $HNO_3$ | 30 s | 30 s | 30 s | 30 s | 30 s | 30 s | 30 s | 30 s | 30 s | 30 s | 30 s | 30 s | 30 s | 30 s |
| Etching | Composition Example 1-3 | | | | | | | | | 30 s | 30 s | 30 s | 30 s | 30 s | 60 s |
| | Composition Comparative Example 1-3 (Zn not added) | | | | | 30 s | 60 s | 120 s | 30 s | | | | | | |
| Nitric acid pickling | 30 wt. % $HNO_3$ | | | | | 30 s | 30 s | 30 s | 30 s | 30 s | 30 s | 30 s | 30 s | 30 s | 30 s |
| Zinc displacement | EPITHAS MCS-31 (acidic zinc displacement) | 45 s | | 45 s | | 45 s | 45 s | 45 s | | 45 s | 45 s | | 45 s | 45 s | 45 s |
| | EPITHAS MCT-51 (alkaline zinc displacement) | | 20 s | | 20 s | | | | 20 s | | | 20 s | | | |
| Nitric acid pickling | 30 wt. % $HNO_3$ | | 30 s | | 30 s | | | | 30 s | | 30 s | 30 s | | | |
| Zinc displacement | EPITHAS MCS-31 (acidic zinc displacement) | | | | | | | | | | 45 s | | | | |
| | EPITHAS MCT-51 (alkaline zinc displacement) | | 40 s | | 40 s | | | | 40 s | | | 40 s | | | |
| Electroless Ni plating | EPITHAS NPR-18 | 900 s | 900 s | 900 s | 900 s | 900 s | 900 s | 900 s | 900 s | 900 s | 900 s | 900 s | 900 s | 900 s | 900 s |
| Ni deposition | | 100% | 100% | 100% (−) | 90% | 30% | 30% | 60% | 60% | 100% | 100% | 100% | 100% | 100% | 100% |

Ex.: Example

Comp. Ex.: Comparative Example

TABLE 2

| Composition | | | | | | | | | | | |
|---|---|---|---|---|---|---|---|---|---|---|---|
| Composition of etchant | | | Comp. Ex. 1-1 | Ex. 1-1 | Ex. 1-2 | Ex. 1-3 | Ex. 1-4 | Comp. Ex. 1-2 | Comp. Ex 1-3 | Ex. 1-5 | Ex. 1-6 |
| Fluoride | Ammonium fluoride (40%) | g/L | 30.0 | 30.0 | 30.0 | 30.0 | 30.0 | 30.0 | 30.0 | 30.0 | 30.0 |
| | Hydro-fluoboric acid (42%) | g/L | | | | | | | | | |
| | Ammonium hydrogen fluoride | g/L | | | | | | | | | |
| | Sodium fluoride | g/L | | | | | | | | | |
| | Potassium fluoride | g/L | | | | | | | | | |
| | Hydrogen fluoride | g/L | | | | | | | | | |
| Buffer | Succinic acid | g/L | 20.0 | 20.0 | 20.0 | 20.0 | 20.0 | 20.0 | 20.0 | 20.0 | 20.0 |
| Metal salt | Zn sulfate 7hydrate (expressed as metal conc.) | g/L | 3.0 | 3.0 | 3.0 | 3.0 | 3.0 | 3.0 | | 1.0 | 5.0 |
| | Fe chloride 6hydrate (expressed as metal conc.) | g/L | | | | | | | | | |

TABLE 2-continued

| Composition | | | | | | | | | | | |
|---|---|---|---|---|---|---|---|---|---|---|---|
| Activator | Newcol 1008 | g/L | 5.0 | 5.0 | 5.0 | 5.0 | 5.0 | 5.0 | 5.0 | 5.0 | 5.0 |
| pH adjuster | 28% ammonia water | g/L | Amount for pH adj. | Amount for pH adj. | Amount for pH adj. | Amount for pH adj. | Amount for pH adj. | Amount for pH adj. | Amount for pH adj. | Amount for pH adj. | Amount for pH adj. |
| Treatment temperature | | ° C. | 35 | 35 | 35 | 35 | 35 | 35 | 35 | 35 | 35 |
| pH | | | 4.0 | 4.5 | 5.0 | 6.0 | 6.5 | 7.0 | 6.0 | 6.0 | 6.0 |
| Ni deposition (evaluated in Ex. 3) | | | 60% | 80% | 90% | 100% | 100% (−) | 60% | 30% | 90% | 100% |

| Composition of etchant | | | Ex 1-7 | Ex. 1-8 | Ex 1-9 | Ex. 1-10 | Ex. 1-11 | Ex 1-12 | Ex. 1-13 | Ex. 1-14 |
|---|---|---|---|---|---|---|---|---|---|---|
| Fluoride | Ammonium fluoride (40%) | g/L | 30.0 | 30.0 | 5.0 | 10.0 | 50.0 | 100.0 | | |
| | Hydro-fluoboric acid (42%) | g/L | | | | | | | 50.0 | |
| | Ammonium hydrogen fluoride | g/L | | | | | | | | 10.0 |
| | Sodium fluoride | g/L | | | | | | | | |
| | Potassium fluoride | g/L | | | | | | | | |
| | Hydrogen fluoride | g/L | | | | | | | | |
| Buffer | Succinic acid | g/L | 20.0 | 20.0 | 20.0 | 20.0 | 20.0 | 20.0 | 20.0 | 20.0 |
| Metal salt | Zn sulfate 7hydrate (expressed as metal conc.) | g/L | 10 | 20 | 3.0 | 3.0 | 3.0 | 3.0 | 3.0 | 3.0 |
| | Fe chloride 6hydrate (expressed as metal conc.) | g/L | | | | | | | | |
| Activator | Newcol 1008 | g/L | 5.0 | 5.0 | 5.0 | 5.0 | 5.0 | 5.0 | 5.0 | 5.0 |
| pH adjuster | 28% ammonia water | g/L | Amount for pH adj. | Amount for pH adj. | Amount for pH adj. | Amount for pH adj. | Amount for pH adj. | Amount for pH adj. | Amount for pH adj. | Amount for pH adj. |
| Treatment temperature | | ° C. | 35 | 35 | 35 | 35 | 35 | 35 | 35 | 35 |
| pH | | | 6.0 | 6.0 | 6.0 | 6.0 | 6.0 | 6.0 | 6.0 | 6.0 |
| Ni deposition (evaluated in Ex. 3) | | | 100% (−) | 90% | 80% | 90% | 100% | 90% | 90% | 100% |

| Composition of etchant | | | Ex. 1-15 | Ex. 1-16 | Ex. 1-17 | Ex. 1-18 | Ex. 1-19 | Ex. 1-20 | Ex. 1-21 | Comp. Ex. 1-4 |
|---|---|---|---|---|---|---|---|---|---|---|
| Fluoride | Ammonium fluoride (40%) | g/L | | | | 30.0 | 30.0 | 30.0 | 30.0 | 30.0 |
| | Hydro-fluoboric acid (42%) | g/L | | | | | | | | |
| | Ammonium hydrogen fluoride | g/L | | | | | | | | |
| | Sodium fluoride | g/L | 5.0 | | | | | | | |
| | Potassium fluoride | g/L | | 5.0 | | | | | | |
| | Hydrogen fluoride | g/L | | | 5.0 | | | | | |
| Buffer | Succinic acid | g/L | 20.0 | 20.0 | 20.0 | 20.0 | 20.0 | 20.0 | 20.0 | 20.0 |
| Metal salt | Zn sulfate 7hydrate (expressed as metal conc.) | g/L | 3.0 | 3.0 | 3.0 | 3.0 | 3.0 | 3.0 | 3.0 | |
| | Fe chloride 6hydrate (expressed as metal conc.) | g/L | | | | | | | | 0.5 |

TABLE 2-continued

| Composition | | | | | | | | | | |
|---|---|---|---|---|---|---|---|---|---|---|
| Activator | Newcol 1008 | g/L | 5.0 | 5.0 | 5.0 | 5.0 | 5.0 | 5.0 | 5.0 | 5.0 |
| pH adjuster | 28% ammonia water | g/L | Amount for pH adj. 35 | Amount for pH adj. 35 | Amount for pH adj. 35 | Amount for pH adj. 25 | Amount for pH adj. 40 | Amount for pH adj. 50 | Amount for pH adj. 60 | Amount for pH adj. 35 |
| pH | | | 6.0 | 6.0 | 6.0 | 6.0 | 6.0 | 6.0 | 6.0 | 6.0 |
| Ni deposition (evaluated in Ex. 3) | | | 100% | 100% | 100% (−) | 80% | 100% | 100% (−) | 80% | 30% |

Ex.: Example
Comp. Ex.: Comparative Example

As shown in Tables 1 and 2, the etchants of the examples containing a zinc compound and a fluorine compound and having a pH of 4.5 to 6.5 achieved good deposition of a metal plating such as a nickel plating, despite their acidity. It should be noted that, although Tables 1 and 2 show the results obtained when the aluminum substrate used is an Al—Si TEG wafer, similar results were obtained when the aluminum substrate used is an Al—Cu TEG wafer. Moreover, in Comparative Examples 1 and 2, good deposition of a metal plating such as a nickel plating was obtained, but the etchants, which were alkaline, can attack materials vulnerable to alkaline components, such as solder resists.

The invention claimed is:

1. A method of surface treatment of aluminum or an aluminum alloy, the method comprising a treatment including: bringing a workpiece having aluminum or an aluminum alloy on its surface into contact with an etchant to etch the workpiece, the etchant comprising at least one zinc compound and at least one fluorine compound, the etchant having a pH of 4.5 to 6.5; and pickling the etched workpiece.

2. The method of surface treatment of aluminum or an aluminum alloy according to claim 1, wherein the treatment is repeated at least twice.

3. The method of surface treatment of aluminum or an aluminum alloy according to claim 2, wherein the etchant used in each repetition of the treatment has the same composition.

4. The method of surface treatment of aluminum or an aluminum alloy according to claim 2, wherein the method comprises zinc displacement after the treatment.

5. The method of surface treatment of aluminum or an aluminum alloy according to claim 4, wherein the method comprises forming a metal plating film after the zinc displacement.

6. The method of surface treatment of aluminum or an aluminum alloy according to claim 1, wherein the method comprises zinc displacement after the treatment.

7. The method of surface treatment of aluminum or an aluminum alloy according to claim 6, wherein the method comprises forming a metal plating film after the zinc displacement.

* * * * *